US010286367B2

(12) United States Patent
Schuler et al.

(10) Patent No.: US 10,286,367 B2
(45) Date of Patent: May 14, 2019

(54) REEL ASSEMBLY FOR A MIXER

(71) Applicant: SCHULER MFG. & EQUIP. CO. INC., Griswold, IA (US)

(72) Inventors: Reggie L. Schuler, Griswold, IA (US); Jared V. Dolch, Elliott, IA (US); John H. Aggen, Anita, IA (US)

(73) Assignee: Schuler Mfg. & Equip. Co. Inc., Griswold, IA (US)

( * ) Notice: Subject to any disclaimer, the term of this patent is extended or adjusted under 35 U.S.C. 154(b) by 132 days.

(21) Appl. No.: 15/480,853

(22) Filed: Apr. 6, 2017

(65) Prior Publication Data

US 2017/0291152 A1 Oct. 12, 2017

Related U.S. Application Data

(60) Provisional application No. 62/319,085, filed on Apr. 6, 2016.

(51) Int. Cl.

*B01F 7/00* (2006.01)
*B01F 7/04* (2006.01)
*B01F 7/08* (2006.01)

(52) U.S. Cl.

CPC ..... *B01F 7/00116* (2013.01); *B01F 7/0005* (2013.01); *B01F 7/00175* (2013.01); *B01F 7/04* (2013.01); *B01F 7/081* (2013.01)

(58) Field of Classification Search

CPC ..... B01F 13/1025; B01F 15/00435; B01F 15/00441; B01F 15/00461; B01F 15/0048; B01F 15/00545; B01F 15/00714; B01F 15/0289; B01F 2015/0011; B01F 2015/00623; B01F 2215/0008; B01F 7/00583; B01F 7/000975; B01F 7/081; A01K 5/002; F16D 7/02; F16D 9/06; F16H 57/025

See application file for complete search history.

(56) References Cited

U.S. PATENT DOCUMENTS

| | | | | |
|---|---|---|---|---|
| 4,506,990 A * | 3/1985 | Neier | A01K 5/002 | 366/299 |
| 4,571,091 A * | 2/1986 | Pardo | B01F 7/165 | 366/311 |
| 4,597,672 A * | 7/1986 | Neier | A01K 5/002 | 366/186 |
| 4,756,626 A | 7/1988 | Neier | | |
| 4,799,800 A * | 1/1989 | Schuler | A01K 5/002 | 366/296 |
| 5,489,152 A * | 2/1996 | Rumph | B01F 7/00075 | 366/311 |
| 6,694,867 B1 * | 2/2004 | Roth | B01F 7/00025 | 366/144 |
| 8,646,967 B2 * | 2/2014 | Marggi | A01K 5/002 | 366/299 |

(Continued)

OTHER PUBLICATIONS

Knight Manufacturing Corporation, Reel Auggie with Hay-Max 3000 Series Mixer, pp. 1-5, Brodhead, Wisconsin, 53520, USA.

*Primary Examiner* — Tony G Soohoo
(74) *Attorney, Agent, or Firm* — Zarley Law Firm, P.L.C.

(57) ABSTRACT

A reel assembly for a feed mixer having a plurality of support plates connected to a central shaft. A plurality of reel bars extend between and are connect to adjacent support plates with a torsion spring assembly.

13 Claims, 6 Drawing Sheets

(56) References Cited

U.S. PATENT DOCUMENTS

| | | | | |
|---|---|---|---|---|
| 2006/0062078 | A1* | 3/2006 | Jejcic | B01F 7/00175 366/310 |
| 2007/0140053 | A1* | 6/2007 | Jejcic | A23G 9/224 366/311 |
| 2013/0062854 | A1* | 3/2013 | Gorrell | B60G 9/02 280/124.169 |
| 2018/0254740 | A1* | 9/2018 | Corio | F24S 25/12 |
| 2018/0282093 | A1* | 10/2018 | Matsui | B65H 9/004 |

* cited by examiner

REEL ASSEMBLY FOR A MIXER

CROSS REFERENCE TO RELATED APPLICATION

This application claims the benefit to Provisional Application U.S. Ser. No. 62/319,085 filed on Apr. 6, 2016.

BACKGROUND OF THE INVENTION

The present invention is directed to a reel assembly for use with a mixer and more particularly to a torsion spring reel assembly.

Reel type feed mixers are well-known in the art. Typically, a feed mixer has a mixing tank having a first, or primary, mixing chamber that is in communication with a smaller second or auxiliary mixing chamber. The primary chamber has a reel that includes a central shaft, support arms that extend radially from the shaft, and reel bars connected between the support arms in a fixed position.

Disposed within the auxiliary chamber, (aka auger trough) are a pair of stacked augers. The augers receive and return feed ingredients from the primary chamber which has a greater volume than the auger trough. The bottom of the auger trough is below the rotational axis of the central shaft of the reel.

As the reel rotates a mixing action is created by the feed ingredients tumbling over as the reel bars come into contact with the feed in the bottom of the primary chamber.

The stacked augers including a top auger with flighting directed such that feed is carried rearward and a lower auger with flighting directed such that feed is carried forward, are rotated in like direction. The lower auger carries feed forward to a discharge door opening in the auger trough. When the discharge door is closed, feed is forced by pressure upwards back into the primary chamber by a short section of reverse flighting at the end of the lower auger. As feed is forced upward the feed comes into contact with upper auger which is directly above the lower auger. The upper auger carries feed away from the discharge door such that the feed spills over into the primary chamber as soon as the feed clears resistance from the feed already in the primary chamber. The augers provide axial movement of the feed ingredients across the length of the primary chamber. The combination of feed tumbling from the reel with the axial movement of the augers provides a circular return pattern that creates a mixed feed ration. Examples of this concept can be found in U.S. Pat. Nos. 4,506,990, 4,597,672, and 4,756,626, incorporated herein by reference in their entireties.

To improve durability of the reel, a coiled compression spring inside the support arm provided relief for the reel bars when the reel bars encountered resistance from the feed ingredients such as forage, hay, cornstalks and the like that can become wedged between the reel bar and the wall of the chamber. While useful, there are problems that exist with the use of the steel coiled springs.

First, the springs typically are exposed to the feed ingredients in the primary chamber. As a result, feed ingredients tend to pack in around the spring, eventually restricting or eliminating any compression action to protect the reel bar from the damage due to wedging. In addition, without compression, wedging can also transmit a shock through the reel assembly to the drive train damaging drive train components.

Second, some feed ingredients are corrosive causing the spring to corrode eventually causing failure. When this occurs the reel bar is compressed to a permanent position that no longer matches the diameter of the chamber. As a result, mixing becomes inadequate and chamber cleanout is difficult. Therefore, a need exists in the art for a device that addresses these deficiencies.

An objective of the present invention is to provide a reel assembly that provides relief to the reel bar assembly that does not corrode.

These and other objectives will be apparent to one skilled in the art based upon the following written description.

SUMMARY OF THE INVENTION

A reel assembly for a feed mixer having a plurality of support plates connected to a central shaft. Preferably, the support plates have a plurality of support arms that extend radially from the central shaft to an outer end. Extending between adjacent support plates are a plurality of reel bars. The reel bars are connected to the support arms of the support plates using a torsion spring assembly. The torsion spring assembly is of any size, shape and structure.

DETAILED DESCRIPTION OF THE PREFERRED EMBODIMENT

Figure 1:
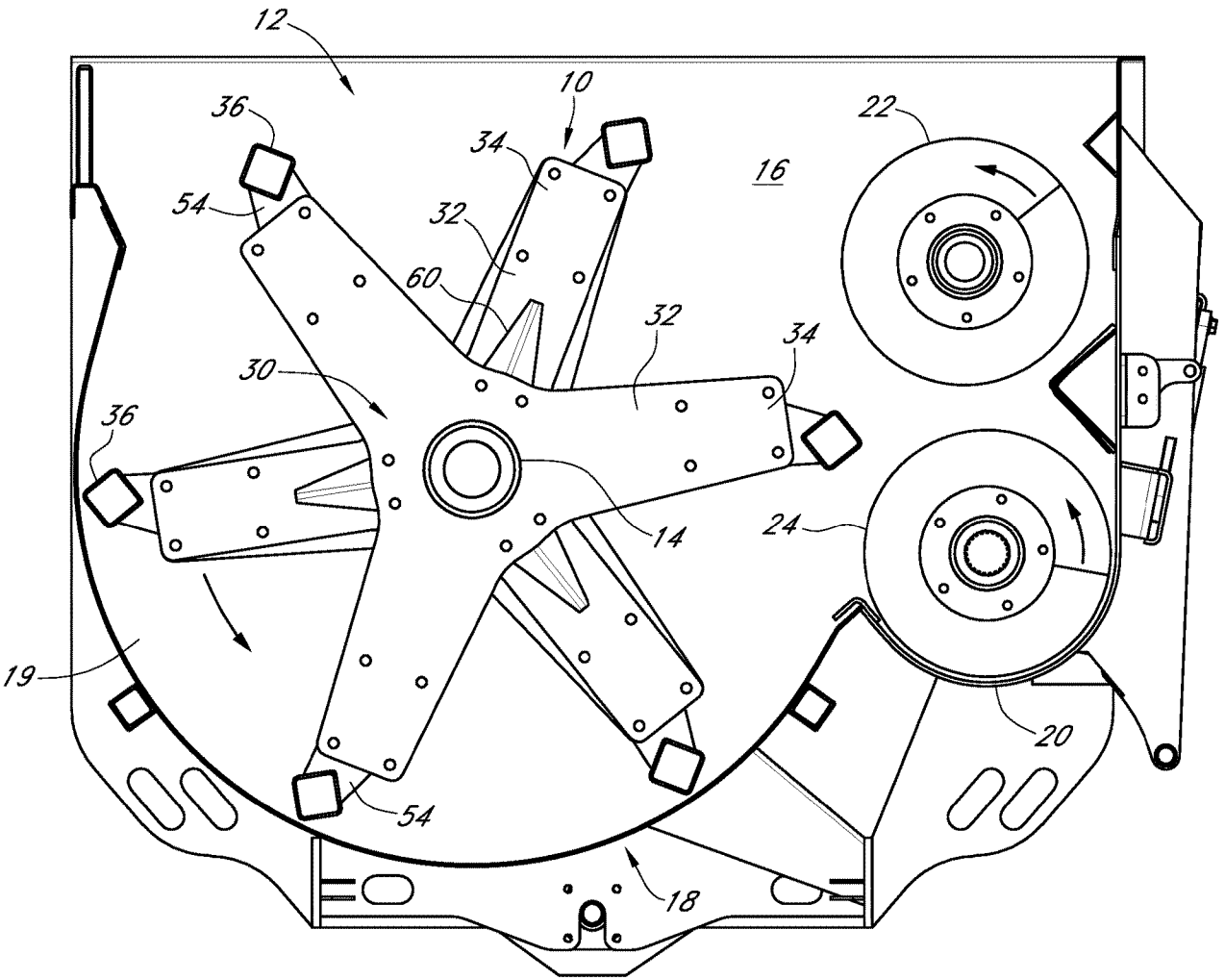
FIG. 1 is a side sectional view of a feeder assembly.
Figure 2:
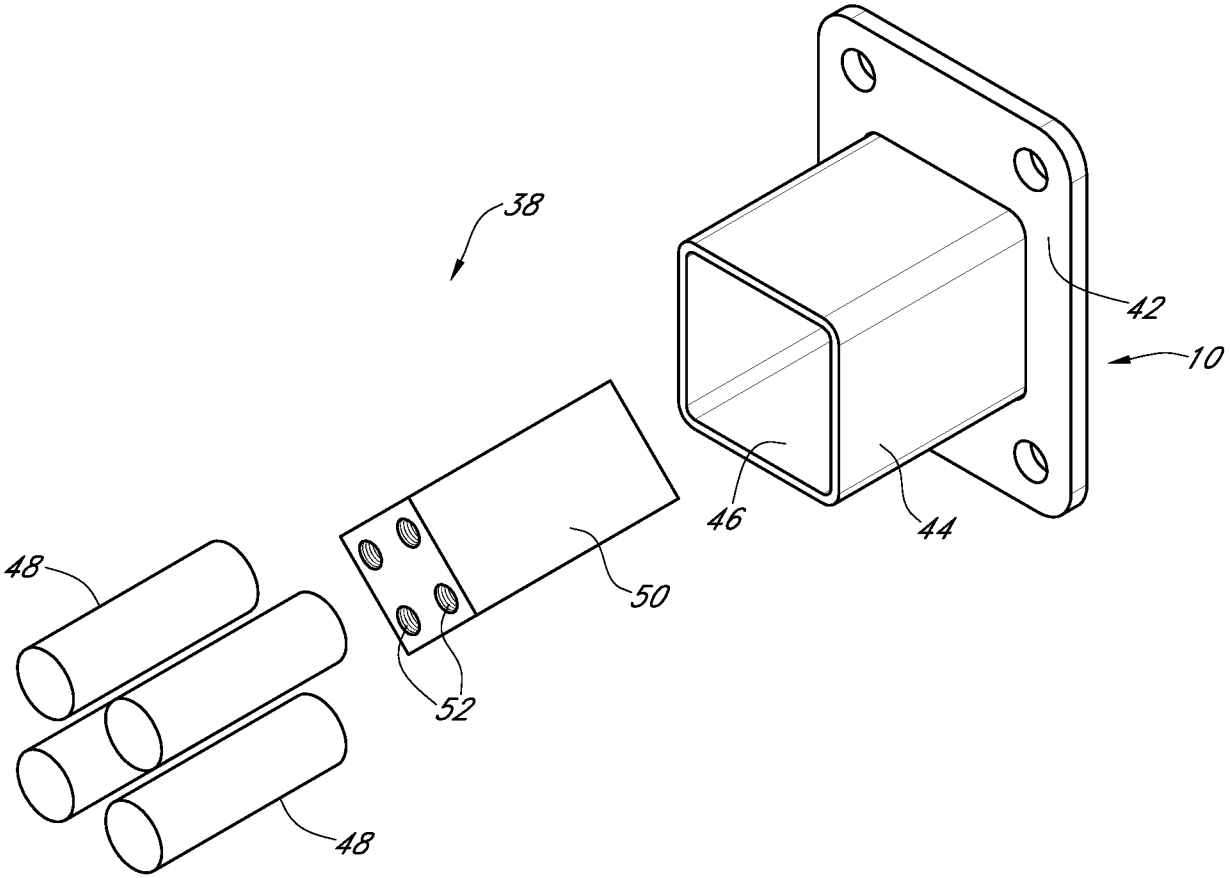
FIG. 2 is an exploded perspective view of a torsion spring assembly.
Figure 3:
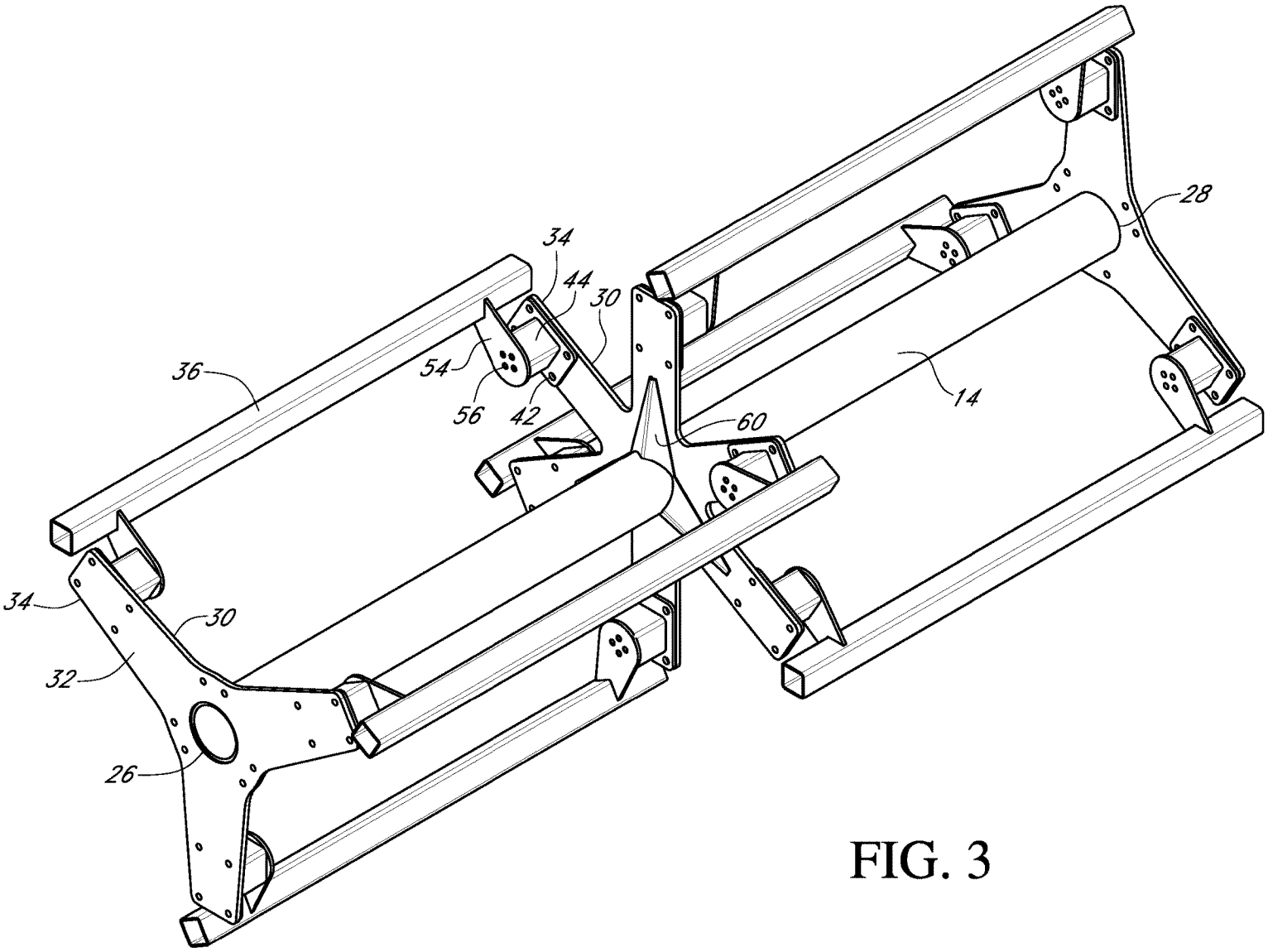
FIG. 3 is a perspective view of a reel assembly.
Figure 4:
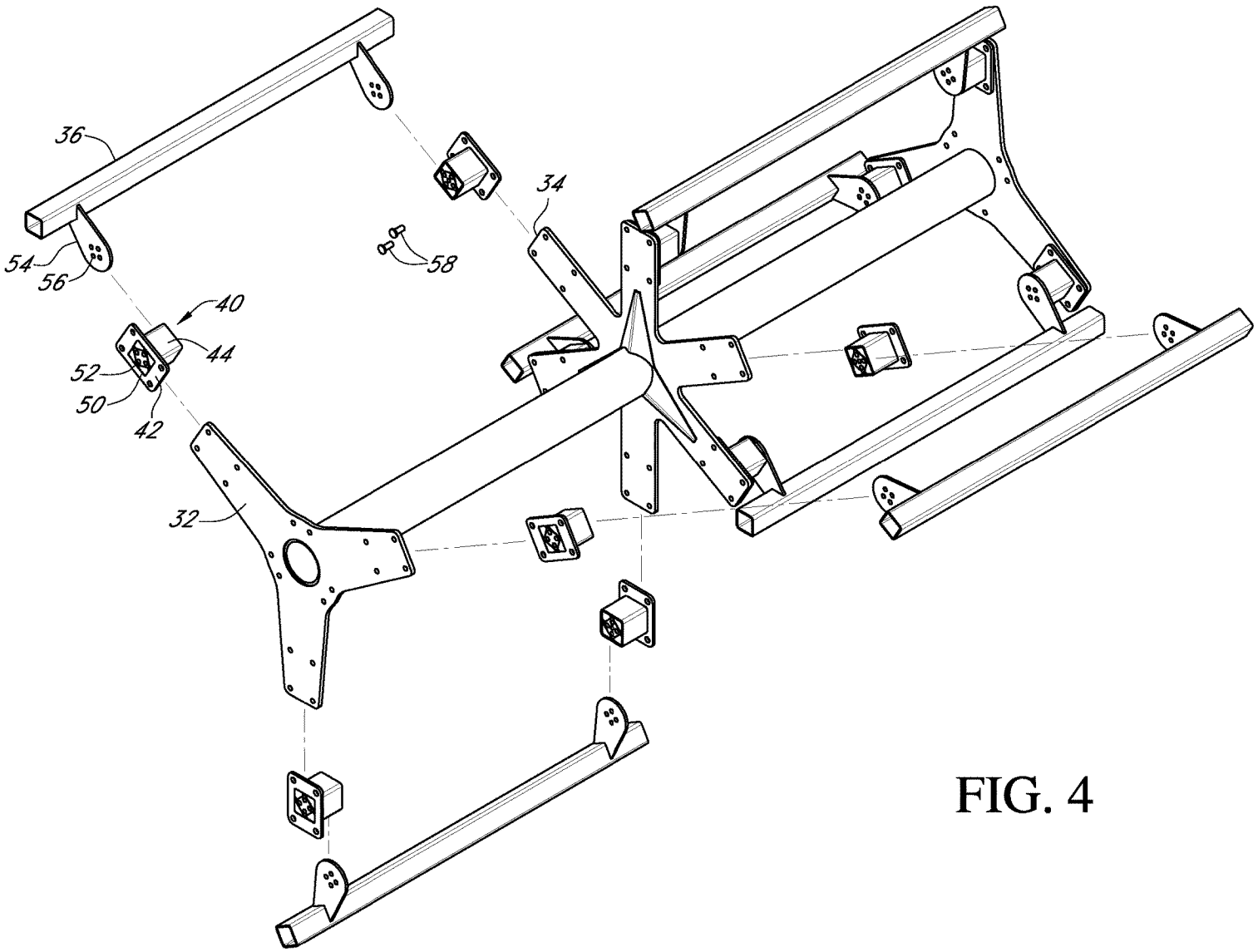
FIG. 4 is an exploded perspective view of a reel assembly.
Figure 5:
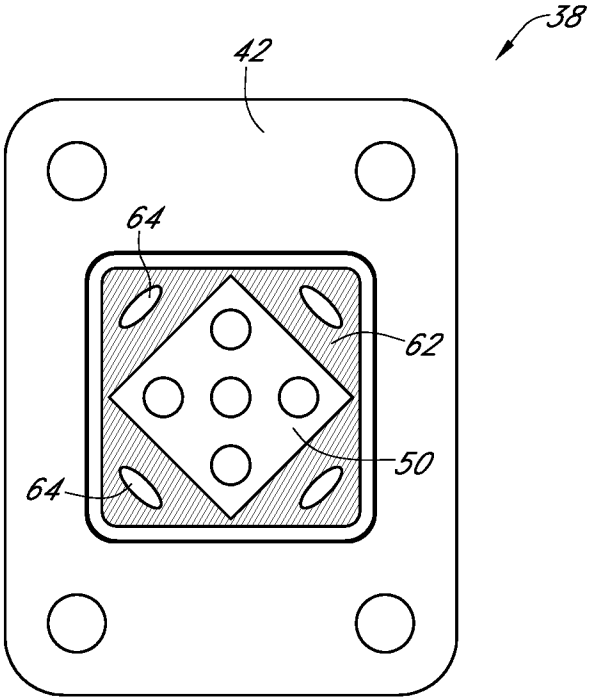
FIG. 5 is an end view of a torsion spring assembly.
Figure 6:
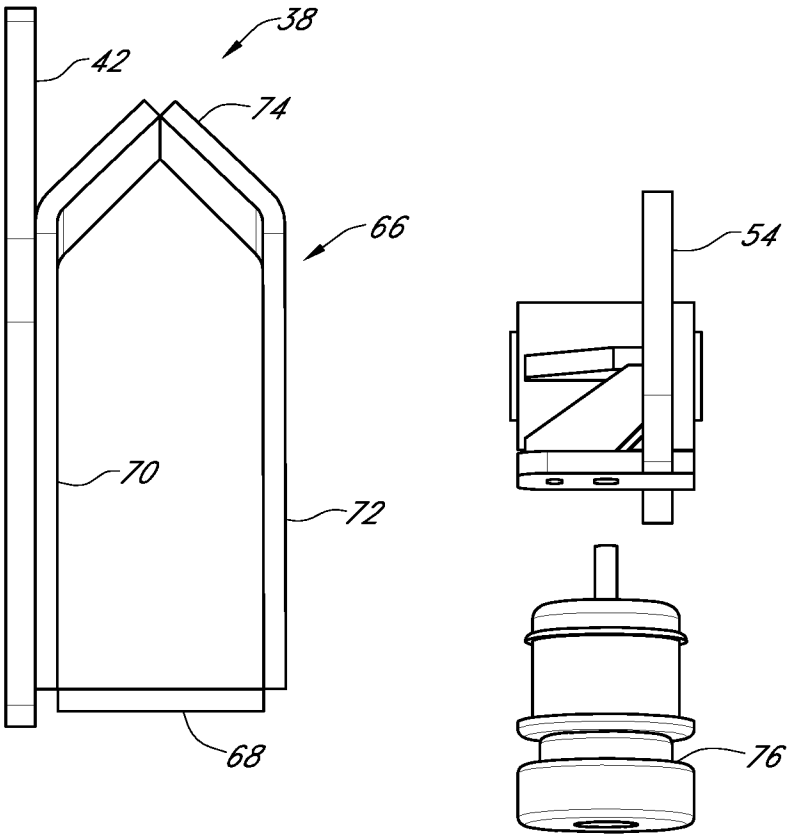
FIG. 6 is an exploded side view of a torsion spring assembly.

Referring to the Figures, a reel assembly 10 for use with a feed mixer 12 has a central shaft 14 that extends through and between end walls 16 of a mixing tank 18. The mixing tank 18 has a first mixing chamber 19 partially separated from a second chamber 20 or auger trough. A pair of augers 22 and 24 are stacked within the auger trough 20. The central shaft 14 and augers are rotatably driven by a drive means (not shown) that is well known in the art.

The central shaft 14 has a first end 26 and a second end 28. Connected to the central shaft 14 are a plurality of support plates 30. Any number of support plates 30 may be used but in a preferred embodiment support plates 30 are connected to ends 26 and 28 and a third support plate 30 is connected to the center of the central shaft 14.

The support plates 30 have a plurality of support arms 32 that extend radially from the central shaft 14 to an outer end 34. Each support plate 30 can have any number of arms 32 and in a preferred embodiment the support plates 30 at ends of 26 and 28 each have three support arms 32 and the center support plate 30 has six support arms 32. In the preferred embodiment the support plates 30 on each end 26 and 28 are offset so that the support arms 32 are not aligned with one another.

Extending between the support arms 32 of the support plates 30 at the ends of 26 and 28 and the support arms 32 of the central support plate 30 are reel bars 36. The reel bars 36 are connected to the support arms 32 with a torsion spring assembly 38.

While the torsion spring assembly 38 is of any size, shape, or structure, in one example the assembly includes a connecting member 40 having a mounting plate 42 and a plurality of walls 44 that extends outwardly from plate 42 to form a hollow chamber 46. In the example shown in the Figures, the walls 44 form a square shape. The mounting plate 42 is connected to the outer end 34 with bolts or rivets.

Disposed within the hollow chamber 46 is at least one compression member 48 and a connecting block 50. The compression member 48 are of any size, shape, and structure and in the example shown the compression members 48 are formed as cylinders. The compression members 48 also are made of any compressible material and in this embodiment are made of a compressible rubber. The connecting block 50 is of a shape that is complimentary to the shape formed by the cavity walls 44. Disposed within the connecting block 50 are a plurality of bores 52.

Attached to each reel bar 36 are a pair of spaced connecting arms 54. The connecting arms 54 extend outwardly from the reel bars and engage an outer end of the connecting member 40. The connecting arms 54 have a plurality of holes 56 that align with the bores 52 of the connecting block 50. Bolts 58 extend through holes 56 and into bores 52 to connect the reel bar 36 to the support arm 32.

The support arms 32 also have a wedge 60 between the outer end 34 and the central shaft 14. The wedges 60 are positioned to funnel feed ingredients toward the reel bars 36 and away from the support arms 32.

In operation, the reel assembly 10 rotates in a particular direction such that the reel bars 36 sweep along the bottom of the mixing chamber 19 and lift feed upwards towards the secondary chamber 20. As the reel assembly 10 rotates the reel bars 36 engage the feed ingredients causing the feed to tumble in combination with the auxiliary movement to the augers 22 and 24. When feed material becomes wedged between the reel bar 36 and the wall of chamber 19, the bar 36 is deflected backwards in the direction opposite of the rotation of the reel assembly 10 providing relief for the feed material to clear. More specifically, when feed material becomes wedged, force or pressure is applied to the reel bar 36. This force is transferred from the reel bar 36 through the connecting arms 54 to bolts 58 to connecting block 50 where the force compresses compression member 48 is covered by the connecting arms 54 to reduce feed material encroachment into chamber 46 to plug or clog the torsion spring assembly 38 or corrode the assembly.

In an alternative embodiment, instead of using at least one compression member 48 in the torsion spring assembly 38 a pourable, elastic, setting compound 62 is used to fill the voids around the connecting block 50 in the hollow chamber 46. The voids are entirely filled with the compound 62, or alternatively, the compound 62 fills the void around removable inserts 64. Once removed, the void left from the inserts 64 facilitates compression of the compound 62. The pourable compound 62 provides a torsional spring action through compression and expansion as the connecting block 50 rotates within the hollow chamber.

In yet another example of a torsion spring assembly 38, a bracket 66 is attached to the mounting plate 42. The bracket 66 has a mounting pad 68, an inner 70 and outer 72 side walls, and an angled top 74. Connected to the mounting pad 68 within the bracket 66 is a compression member 76. The compression member 76 is of any type and preferably is made of rubber or other elastic composite. A connecting arm 54 is rotatably mounted within the bracket 66 and positioned to engage and compress the compression member 76 against the mounting pad 68. More specifically, the connecting arm 54 is formed and positioned to compress the compression member 76 when the connecting arm 54 is rotated.

Therefore, a reel assembly 10 has been disclosed that at the very least meets all the stated objectives.

What is claimed is:

1. A reel assembly, comprising:

a central shaft;

a plurality of support plates connected to the central shaft, wherein the support plates have plurality of support arms that extend radially from the central shaft to an outer end; and a plurality of reel bars that extend between the plurality of support plates and are connected to the support arms of the support plates with a torsion spring assembly having a compression member made of a compressible rubber cylinder.

2. The reel assembly of claim 1 wherein the support arms have a wedge.

3. The reel assembly of claim 1 wherein the plurality of reel bars are connected to the plurality support arms of the plurality support plates by a pair of connecting arms.

4. The reel assembly of claim 1 wherein the torsion spring assembly includes a connecting member having a mounting plate and a plurality of walls that extend outwardly from the mounting plate to form a hollow chamber, and at least one compression member and a connecting block disposed within the hollow chamber.

5. The reel assembly of claim 1 wherein the plurality of support plate includes a first support plate at the first end of the central shaft, a second support plate at a second end of the center shaft, and a third support plate between the first support plate and the second support plate.

6. The reel assembly of claim 5 wherein the reel bars connected between the first support plate and the third support plate are offset from the reel bars connected between the second support plate and the third support plate.

7. The reel assembly of claim 1 wherein the torsion spring assembly includes a bracket attached to a mounting plate, a compression member connected to the bracket, and within the bracket and connecting arm rotatably mounted within the bracket, and positioned to engage the compression member.

8. A reel assembly, comprising:

a central shaft;

a plurality of support plates connected to the central shaft, wherein the support plates have plurality of support arms that extend radially from the central shaft to an outer end; and a plurality of reel bars that extend between the plurality of support plates and are connected to the support arms of the support plates with a torsion spring assembly wherein the torsion spring assembly includes a pourable setting composite that fills voids between a connecting block and walls of an inner chamber.

9. A reel assembly comprising:

a central shaft;

a plurality of support plates connected to the central shaft wherein the support plates have a plurality of support arms that extend radially from the central shaft to an outer end;

a plurality of torsion spring assemblies connected to the outer end of the support arms and having a connecting member that include a hollow chamber with at least one compression member disposed therein;

a plurality of connecting arms attached to the connecting members; and a plurality of reel bars connected to the connecting bars and extending between the plurality of support plates.

10. The reel assembly of claim 9 wherein the connecting member has a connecting block having a plurality of bores.

11. The reel assembly of claim 10 wherein the connecting arms have a plurality of holes that align with the bores of the connecting block.

12. The reel assembly of claim 4 wherein the torsion spring assembly includes four compression members that surround a square compression block.

13. The reel assembly of claim 5 wherein the first and second support plates have three support arms and the third support plate has six support arms.

* * * * *